US006065403A

United States Patent [19]

Haglund

[11] Patent Number: 6,065,403

[45] Date of Patent: May 23, 2000

[54] IGNITION DEVICE

[75] Inventor: Nils Haglund, Torshälla, Sweden

[73] Assignee: Bofors AB, Karlskoga, Sweden

[21] Appl. No.: 08/945,597

[22] PCT Filed: Apr. 26, 1996

[86] PCT No.: PCT/SE96/00552

§ 371 Date: Jan. 16, 1998

§ 102(e) Date: Jan. 16, 1998

[87] PCT Pub. No.: WO96/35097

PCT Pub. Date: Nov. 7, 1996

[30] Foreign Application Priority Data

May 2, 1995 [SE] Sweden ..... 9501604

[51] Int. Cl.[7] ..... F42C 19/06

[52] U.S. Cl. ..... 102/216

[58] Field of Search ..... 102/216, 211, 102/266, 272, 488, 500

[56] References Cited

U.S. PATENT DOCUMENTS

| | | | |
|---|---|---|---|
| 914,371 | 3/1909 | Davis | 102/216 |
| 2,887,056 | 5/1959 | Perret | 102/216 |
| 3,111,901 | 11/1963 | Dodson et al. | 102/216 |
| 3,188,960 | 6/1965 | Samburoff | 102/216 |
| 3,667,393 | 6/1972 | Aronsson et al. | 102/216 |
| 4,513,664 | 4/1985 | Edmonds | 102/216 |
| 4,793,256 | 12/1988 | Webb | 102/216 |
| 4,831,936 | 5/1989 | Brattstrom et al. | 102/216 |
| 4,913,057 | 4/1990 | Kropp et al. | 102/216 |
| 5,157,221 | 10/1992 | Ronn | 102/216 |

FOREIGN PATENT DOCUMENTS

| | | |
|---|---|---|
| 0 196 283 A1 | of 1986 | European Pat. Off. . |
| 0 285 212 A2 | of 1988 | European Pat. Off. . |
| 0 433 254 A1 | of 1991 | European Pat. Off. . |
| 2 294 426 A1 | of 1976 | France . |

*Primary Examiner*—Michael J. Carone
*Assistant Examiner*—Denise J Buckley
*Attorney, Agent, or Firm*—Pollock, Vande Sande & Amernick

[57] ABSTRACT

An ammunition bearing unit is provided. The unit includes at least three casings. When the ammunition bearing unit strikes a target, the casings are deformed and make successive electrical contacts. A detecting unit is arranged to detect a time difference between the successive electrical contacts created by the deformation of the casings. The detecting unit generates an initiation signal only if the time difference exceeds a selected value. An ignition system sends a signal to a charge as a function of the electrical contacts.

12 Claims, 1 Drawing Sheet

IGNITION DEVICE

TECHNICAL FIELD

The present invention relates to an ignition system arrangement for an ammunition-bearing unit, for example a unit in the form of a shell or missile. The ignition system is in this case of the type which comprises casings which establish electrical contact in the event of deformation caused by striking a target. The ignition system also comprises a unit which detects when electrical contact is established and which sends an initiation signal or trigger signal to the charge (ignition system) of the ammunition-bearing unit as a function of the electrical contact established.

BACKGROUND OF THE INVENTION

It is known to design ignition systems for antitank shells and missiles by arranging a twin casing of electrically conductive material in the nose of the shell or of the missile. The twin casing is surrounded, if appropriate, by a protective envelope. The operating principle is that when the envelope is deformed and the twin casing lying inside it (or possibly unprotected) is deformed, an electrical contact is established between the two parts of the twin casing. This contact is utilized for triggering the ignition system of the shell or of the missile.

The invention is preferably used in ammunition for combating tanks. As means of defense against shells and missiles of the type in question, the tanks can use warheads which expel splinters in the direction of the shell or the missile. The approaching shell or missile is exposed to a cluster of splinters when it is located relatively close to the tank. The purpose of the splinters is either to directly initiate the explosive of the shell or of the missile, or to initiate the shell or missile ignition system by means of a modest investment in terms of material volume, velocity, money and technical sophistication. There is therefore a need for making the approaching shell or missile as insensitive as possible to the said splinters, so that the shell or the missile reaches its target and is triggered there.

SUMMARY OF THE INVENTION

The main aim of the present invention is to propose an arrangement which solves the problems which have been mentioned above. In the present invention, the contact-establishing casings are at least three in number, and the detecting unit is arranged to detect the time difference between the successive contacts established by the casings upon deformation. A further embodiment is that the unit generates the initiation signal or the trigger signal only if the time difference exceeds a selected value.

In one proposed embodiment, a triple casing is provided in which the middle casing is equipped with electrical contact material on both of its sides. A first contact is, in this case, intended to be established between the inner side of the outer casing and the outer side of the middle casing, or between the inner side of the middle casing and the outer side of the inner casing. A second contact can be established between the inner side of the middle casing and the outer side of the inner casing, or, respectively, between the inner side of the outer casing and the outer side of the middle casing.

Contact is usually first made between the inner side of the outer casing and the outer side of the middle casing.

A timing member can be included and can be triggered when the first electrical contact is established. The timing member causes generation of the initiation signal or equivalent signal if a predetermined time elapes after the first contact is established. In the case where the second electrical contact is established within the predetermined period of time, the timing member discontinues its time measurement, and no initiation signal or trigger signal is generated from the timing member.

In one embodiment, the detecting member can calculate the impact velocity, when a deformation occurs, with the aid of the measured time difference between the first and second contacts established, and the distances between the casings. In the case where the calculated velocity is less than the maximum velocity of the ammunition-bearing unit with a certain increment, or another velocity determined or calculated in some way, the detecting unit generates the initiation signal or trigger signal. If, in contrast, the calculated velocity exceeds the maximum velocity of the ammunition-bearing unit with the same increment, the detecting unit does not generate any initiation signal or trigger signal.

In one embodiment, the detecting unit also operates with an upper time limit. If contact is established in the ammunition-bearing unit's trajectory at a distance before the target, and the calculated time after the first contact is established exceeds an upper value, the triple casing function is disengaged and a twin casing function (which can be conventional) is engaged, i.e. two remaining casings of the triple casing function as twin casing.

In a further embodiment, one or more casings of the triple casings can comprise sections which are constructed using contact material and which are insulated from one another. Each section can establish an individual electrical contact which can be registered or can be distinguished by the detecting unit. With the aid of the sections, vulnerability to approaching splinters is reduced to an even greater extent. The detecting unit can be made to ignore contacts established by individual sections during the trajectory of the missile or of the shell. The triggering condition or triggering conditions can be altered successively during the ammunition unit's approach to the target depending on whether it is exposed to splinter attack. In a further embodiment, the triple casing arrangement is included in a combination with a further ignition system which can be initiated by shock waves in the casing or frame of the unit.

With the aid of what has been proposed above, a structure with a triple casing can utilize the times at which short-circuiting of the casings occurs as a type of velocity indicator. Short-circuits which indicate impact velocities greater than a selected/specific velocity of the shell in its trajectory can be ignored. It is possible in this context to start from the maximum velocity, or to perform some estimation, in order to arrive at a better value for the velocity than the maximum value. In certain known missile systems it is possible to obtain from automatic guidance controls and the like a velocity value which is appropriate for the circumstances. The upper margin chosen is, in this case, greater the more uncertain the value of the actual velocity.

A triple casing is designed mechanically in a similar way to a conventional twin casing. The triple casing can thus be used to discriminate between splinter hits and target impact. The invention is also concerned in making the shell or the missile function upon target impact even in the event of one or more splinter hits short-circuiting the connection between two casings or between all three casings. In this context it is possible to have the triple casing sectioned in accordance with the above. The advantage of this is that in addition to the triple casing being able to distinguish between splinter hits and target impact, the triple casing is capable of triggering the shell's warhead, even when a section has already been short-circuited. The logics system of the shell can be made to successively disengage sections which have been penetrated and short-circuited by splinters. The requirement for triggering of the warhead can thus be altered successively, by which means the function of the ignition system is only gradually altered to the extent that in some cases it takes longer for the shell or equivalent to be triggered after striking the target.

One way of making the shell even more resistant to attack by splinters is to coordinate an ignition system with triple casing, and sectioning of one or more of the casings, with an ignition system which detects shock waves in the casing or frame of the shell. These ignition systems are often placed far back in the shell and are therefore well protected against attack, although they can be activated by shock waves which are generated by splinters striking the shell. The logic in a shell with triple casing or sectioned triple casing can also be constructed in such a way that, in the event of damage to the multiple casing system, a shock wave-detecting system will be connected. This system will not be able to discriminate between splinter hits and target impact, but it can be used as a back-up when the ordinary ignition system has been rendered non-operational by being fired on, for example because too many sections have been penetrated by splinters.

BRIEF DESCRIPTION OF THE FIGURES

A presently proposed embodiment of an arrangement according to the invention will be described hereinbelow, with reference being made at the same time to the attached drawing in which.

DETAILED DESCRIPTION OF THE INVENTION

Figure 1:
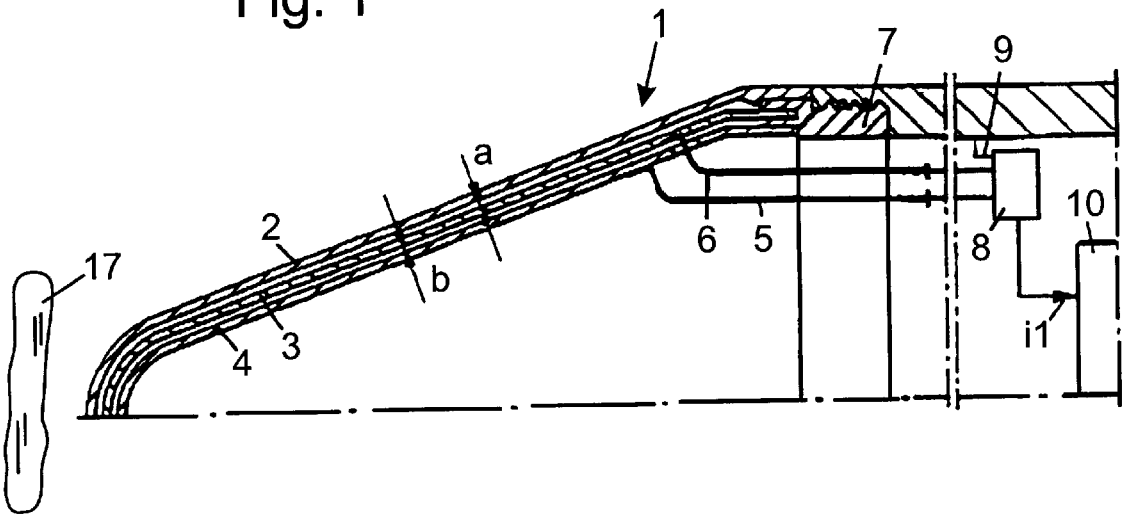
FIG. 1 shows, in longitudinal section, the front parts of an ammunition-bearing unit with an ignition system comprising a triple casing.

In FIG. 1, reference number 1 designates the front parts of an ammunition-bearing unit. The unit comprises a triple casing arrangement with casings 2, 3 and 4. The outer casing 2 has a shape which is determined by the requirements in respect of air resistance, firing conditions, ammunition type, etc. In the example illustrated, the two casings 3 and 4 lying inside have a shape in which they run substantially parallel to the shape of the outer casing. The three casings are electrically conductive, and contact between them occurs when they are deformed or short-circuited in another way. In certain applications, insulation between the casings is guaranteed by having layers of insulating material between the casings. For reasons relating to strength, the inner casings can be made of insulating material, for example, glass-fiber reinforced plastic on which contact material linings are arranged. Contact can therefore be established between the inner surface of the outer casing 2 and the outer surface of the middle casing 3, and between the inner surface of the middle casing 3 and the outer surface of the inner casing 4. The wires can be drawn from the triple casing in a known manner se, so that the envelope of the shell can constitute a first conductor, while insulated cables or wires 5 and 6 are guided, in the example illustrated, through the inside of the warhead to the ignition system. In certain designs, for example in missiles, one or more wires can be arranged on the outside of the body of the missile or equivalent.

Figure 2:
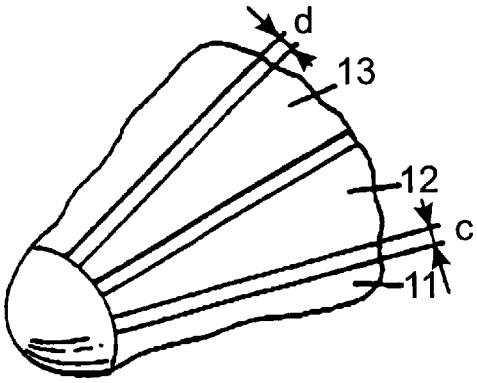
FIG. 2 shows, in a perspective view, parts of a casing which have metal contact surfaces forming sections which are electrically insulated from one another.

In one embodiment, the supporting inner casings are secured on a sleeve 7 in the interior of the shell, and the metal linings of the supporting casings are finished such that they do not make contact with the said sleeve. The conductors 5 and 6 are connected to a detecting unit 8 which is placed in the unit 1 and which is additionally connected to the conductive frame via a conductor 9. As a result of the said contacts which are established, the detecting unit will generate an initiation signal i1 to the charge of the ammunition-bearing unit, which charge is symbolized by 10. The structure of the unit 1 may be of a known type and will not be described in any great detail here. One or more of the casings 2, 3, 4 can support contact material linings which are designed as sections 11, 12, 13, etc. according to FIG. 2. The sections are insulated from one another and in this case there are individual wires drawn from the sections to the unit 8. The distances between the casings are indicated by a, b in FIG. 1. The distances between the sections 11, 12, 13 in FIG. 2 are indicated by c and d. Instead of having the envelope of the shell constitute the first conductor in the manner described above, this first conductor can be formed, like the conductors 5 and 6, by an insulated cable or wire.

Figure 3:
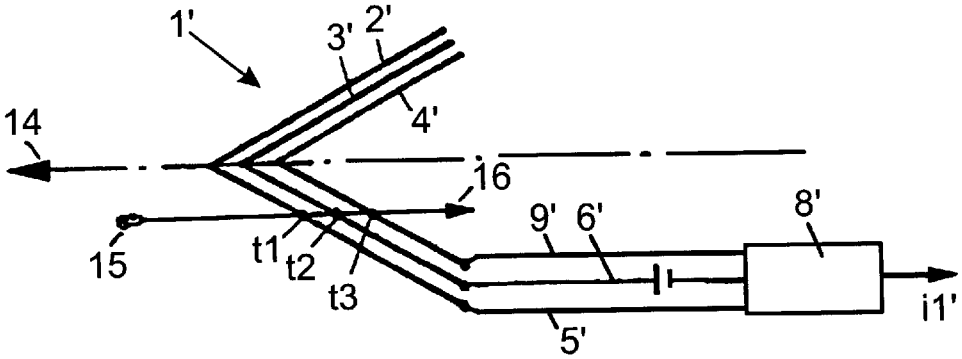
FIG. 3 shows, in circuit diagram form, the function of the triple casing according to FIG. 1.

In FIG. 3, the flight direction of the unit 1' is indicated by the arrow 14. A splinter fired at the unit 1' is shown by 15, and the direction of the splinter is indicated by 16.

On target impact, which is often relatively slow (200–300 m/s), the nose of the shell or of the unit will probably be deformed gradually. At a time t1 shown in FIG. 3, short-circuiting occurs between the outer casing 2' and the middle casing 3'. At a time t2, short-circuiting occurs between the two inner casings 3' and 4'. The time t3 indicates the time when the splinter passes through the inner casing. The time interval between the short-circuits can be calculated based on the velocity of the shell relative to the target and the distance between the casings. Assuming a shell velocity of 300 m/s and a distance a, b of 2 mm between the casings, short-circuiting between the casings 2' and 3' will occur about 6.7 microseconds after impact, and short-circuiting between the casings 3' and 4' will occur after a further 6.7 microseconds. The time between the short circuits is 6.7 microseconds. In one illustrative embodiment, the unit 8' is arranged or programmed to initiate the shell warhead only if the time between the short circuits is longer than a specified value, for example 5 microseconds. A safety margin is thus obtained by means of the last-mentioned time being shorter than the first-mentioned time. The time specifications, distances etc. chosen can be different in different constructions. Typically, the time period between the first and second contacts is in a range of 4–40 microseconds.

If a counterattacking means, for example the said splinter 15, hits the shell, the former will normally have a considerably greater velocity than the shell itself, typically 1000 m/s, to which is added the shell's own velocity. Splinters (and secondary splinters) will in most cases be able to cause electrical contact to be established if they exceed the measurements a and b according to FIG. 1. Thus, for example, splinters, for instance the splinter 15, can generate two short-circuits with shorter time intervals than approximately 2 microseconds. The margin between these two microseconds and the previously mentioned 6.7 microseconds is great, and discrimination between target and splinter can be effected relatively easily with the aid of the detecting unit or logics 8'.

The unit 8, 8' can comprise a timing member which measures the time between the first and second contacts being established. Since the distances a, b are known, the velocity on target impact and on collision with approaching splinters can also be calculated by the unit and related to the maximum velocity of the shell. Velocities which are below a certain predetermined shell velocity result in generation of the initiation signal i1' from the unit 8'. If the velocity is greater than the shell velocity, the signal i1' is not generated. Safety margins can in this case be easily implemented in the unit 8'.

Since the ignition system will comprise a triple casing, it may happen that a fragment/splinter piece remains in the triple casing and thus short-circuits either the inner or the outer circuit. The logic in the system can, in this case, ignore this short-circuit if it persists for a relatively long time, for example a few milliseconds, after which the ignition system can function as a twin casing with the remaining open, unaffected circuit (the twin casing). It may also happen that both the contacts are short-circuited. The shell or missile is thereafter without an ignition system. However, if the ignition system is designed with sectioned casings according to FIG. 2, the logic system 8' of the shell will be able to cope with individual splinter hits of this type too.

In FIG. 1, a symbolically represented target is indicated by 17.

The construction of the detecting unit 8, 8' in conjunction with a sectioned casing, is described in Swedish patent number SE 9501603 (ignition system arrangement) corresponding to U.S. patent application Ser. No. 08/945,711, incorporated herein by reference, which was filed on the same day by the same Applicant.

The invention is not limited to the embodiment which has been shown hereinabove by way of example, but can be modified within the scope of the following patent claims and the inventive concept.

What is claimed is:

1. An ignition system for an ammunition-bearing unit comprising casings for establishing electrical contact upon deformation caused by striking a target, and a unit for detecting when electrical contact is established and for sending an initiation signal to the charge of the ammunition-bearing unit as a function of an established electrical contact, the detecting unit detecting a time difference in successive contacts established by the casings upon deformation, and generating the initiation signal if the time difference exceeds a selected value.

2. A system according to claim 1 wherein said casings include an outer, middle and inner casing, said middle casing being provided with electrical contact material on both sides thereof, and a first electrical contact can be established, upon deformation, by one of the following: 1) between the inner side of an outer casing and the outer side of the middle casing, or 2) between the inner side of the middle casing and the outer side of the inner casing, and a second contact can be established by one of the following: 1) between the inner side of the middle casing and the outer side of the inner casing, or 2) between the inner side of the outer casing and the outer side of the middle casing.

3. A system according to claim 1 further including a timing member initiated when a first electrical contact is established, the timing member causing generation of an initiation signal if a predetermined time has elapsed after the establishing of the first electrical contact.

4. A system according to claim 3, wherein the timing member discontinues time measurement if a second electrical contact is established within a predetermined period of time.

5. A system according to claim 1, wherein an impact velocity, upon deformation, is calculated by the detecting unit which detects the time difference between first and second contacts being established and based on information regarding distances between the casings, whereby 1) when the calculated velocity is less than the velocity of the ammunition-bearing unit at the target site, the detecting unit generates the initiation signal or trigger signal, and 2) when the calculated velocity exceeds the velocity of the ammunition-bearing unit, the detecting unit does not generate the initiation or trigger signal.

6. A system according to claim 5, wherein the detecting unit operates with an upper time limit between first and second contacts, and when a time is being calculated above the upper time limit, when one contact has been established at a considerable distance from the target which gives rise to a time measurement of a few milliseconds, the detecting unit ignores the time and/or velocity measurements.

7. An arrangement according to claim 1, wherein the casings comprise inner and middle casings which are constructed using contact material applied on a support made of an insulating material.

8. An arrangement according to claim 1, wherein the time period between first and second contacts is selected in a range of 4–40 microseconds.

9. An arrangement according to claim 1, wherein at least one casing comprises contact material sections which are electrically insulated from each other and capable of delivering to the detecting unit information on individual electrical contacts established, and wherein the detecting unit can ignore contacts established by the sections at a considerable distance from the target, and successively alter a triggering condition.

10. An arrangement according to claim 1, wherein the ignition system is included in a combination with a further ignition system which can be initiated by shock waves in the ammunition-bearing unit.

11. An arrangement according to claim 1, wherein the casings comprise inner and middle casings which are constructed using contact material applied on a support made of glass-fiber reinforced plastic.

12. An arrangement according to claim 1, wherein at least one casing comprises contact material sections which are electrically insulated from each other and capable of delivering to the detecting unit information on individual electrical contacts established, and wherein the detecting unit can successively alter a triggering condition.

* * * * *